United States Patent [19]

Sturm

[11] Patent Number: 4,651,999

[45] Date of Patent: Mar. 24, 1987

[54] ARROW STRING TRACKING APPARATUS

[76] Inventor: Michael O. Sturm, 552 Country Club Blvd., Des Moines, Iowa 50312

[21] Appl. No.: 886,804

[22] Filed: Jul. 18, 1986

[51] Int. Cl.[4] ..... F41B 5/02

[52] U.S. Cl. ..... 273/416

[58] Field of Search ..... 273/416, 418–422; 89/1.34; 102/504

[56] References Cited

U.S. PATENT DOCUMENTS

| | | | |
|---|---|---|---|
| 3,417,994 | 12/1968 | Rohrbaugh, Jr. | 273/418 |
| 3,993,311 | 11/1976 | Johnson | 273/420 |
| 4,212,463 | 7/1980 | Repinski et al. | 273/422 X |
| 4,252,325 | 2/1981 | Weems et al. | 273/416 |

OTHER PUBLICATIONS

Zwickey Archery, Inc., "Zwickey Scorpio", Advertisement (1) sheet from Bowhunter Magazine—Nov. 1984.

1986 Saunders Successories Catalog, p. 9, "Arrow Penetration Limiter".

*Primary Examiner*—Paul E. Shapiro

*Attorney, Agent, or Firm*—Henderson & Sturm

[57] ABSTRACT

A string tracking apparatus for archery arrows including a arrow having a hollow tubular shaft with a point attached to one end of the shaft. A nock is attached to the other end of the shaft and fletching is disposed near the nock for stabilizing the arrow in flight. A coil of flexible line is disposed within the hollow shaft and one end of it is attached to one end of the shaft. A hook-shaped catching structure is attached to the other end of the flexible line. In one embodiment of such structure, the hook-shaped catching device is frictionally disposed around the front end of the shaft or around the front end of the point attached to the shaft. In this embodiment, when the arrow is shot through an object, such as a turkey, the hook-shaped catching device will not pass through the object although the arrow may very well pass therethrough. If it is a turkey that the arrow has passed through, then the hook-shaped catching device will be attached to the turkey and the arrow will be sticking into the ground or laying on the ground. When the turkey runs away, the string within the shaft will unwind so that the hunter can find the turkey by following the flexible line.

11 Claims, 22 Drawing Figures

ARROW STRING TRACKING APPARATUS

TECHNICAL FIELD

This present invention relates generally to archery, and more particularly to string tracking devices for enabling a bow hunter to follow string to the game hit with an arrow.

BACKGROUND ART

One of the problems with bow hunting is tracking down the game after it has been shot. When a bow hunter hits a mammal such as deer or elk with a well placed arrow, the animal can be easily tracked down by following a blood trail, unless it is raining or snowing or for some other reason the blood trail is covered up quickly. Tracking for turkeys or other birds is not so simple because they do not leave a well defined blood trail regardless of how well they are hit. Furthermore, in the case of turkeys, it is very common for the arrow to pass completely through the turkey. While this happens quite often with deer or elk hunting, it almost always happens while turkey hunting unless the arrow has been modified to prevent it from doing so. Accordingly, there is a problem sometimes in finding game which does not leave a well defined blood trail.

The aforementioned problem has been solved to some degree by using string tracking devices which have a spool of string attached to the bow with the other end of the string attached to the arrow. When the arrow is shot, the string unwinds from the spool attached to the bow, and then the string can be followed from the spool to the arrow to find the game. A problem with these devices is that they tend to slow down the speed of the arrow, sometimes causing the archer to shoot low. A further problem with prior art string tracking devices is that they tend to be somewhat cumbersome and the string sometimes catches on brush or the like and unwinds from the spool, thereby rendering them inoperative until the string is rewound so that there is no excess string dragging on the ground or onto bushes or the like.

Similar structures have been used for bow fishing wherein a reel such as that used in fishing has a line thereon which is attached to an arrow. Then when the arrow is shot, the string unwinds from the reel and then the fish can be reeled in by pulling the arrow back to the bow, which is attached to the reel. This system works well for bow fishing, but does not work very well for bow hunting for turkeys or large mammals.

Accordingly, there is a need for string tracking devices which do not have the aforementioned problems associated therewith.

DISCLOSURE OF THE INVENTION

The present invention relates generally to a string tracking apparatus for archery arrows including a arrow having a hollow tubular shaft with a point attached to one end of the shaft. A nock is attached to the other end of the shaft and fletching is disposed near the nock for stabilizing the arrow in flight. A coil of flexible line is disposed within the hollow shaft and one end of it is attached to one end of the shaft. A hook-shaped catching structure is attached to the other end of the flexible line. In one embodiment of such structure, the hook-shaped catching device is frictionally disposed around the front end of the shaft or around the front end of the point attached to the shaft. In this embodiment, when the arrow is shot through an object, such as a turkey, the hook-shaped catching device will not pass through the object although the arrow may very well pass therethrough. If it is a turkey that the arrow has passed through, then the hook-shaped catching device will be attached to the turkey and the arrow will be sticking into the ground or laying on the ground. When the turkey runs away, the string within the shaft will unwind so that the hunter can find the turkey by following the flexible line.

In a second embodiment of the invention, the hook-shaped catching device extends out the side of the shaft and will catch onto an object which the arrow passes through thereby connecting the object to the arrow by the coil of flexible line within the shaft so that one can always find the object by following the string from the arrow to such object.

An object of the present invention is to provide an improved string tracking apparatus for bow hunting.

Another object of the present invention is to provide a string tracking apparatus which is self-contained to an arrow and need not be attached to an archery bow.

Other objects, advantages and novel features of the present invention will be apparent from the following detailed description of the invention when considered in conjunction with the accompanying drawings.

BEST MODES FOR CARRYING OUT THE INVENTION

Figure 1:
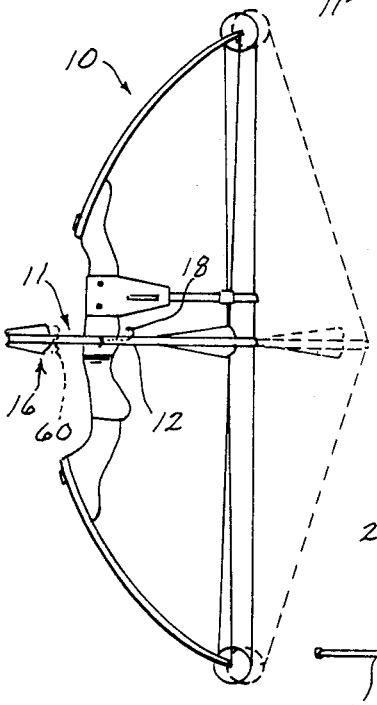
FIG. 1 is a side elevational view of a compound bow having an arrow in readiness to be shot therefrom having the present invention associated therewith.
Figure 3:
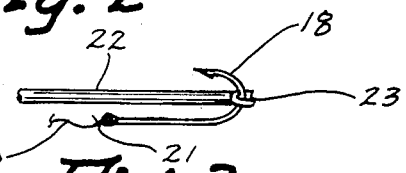
FIG. 3 is a partial view of a way to insert the hook into an opening in the shaft.
Figure 4:
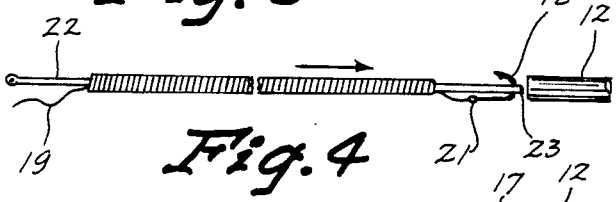
FIG. 4 shows a rod for inserting the hook and coil of string into the shaft of an arrow.
Figure 5:
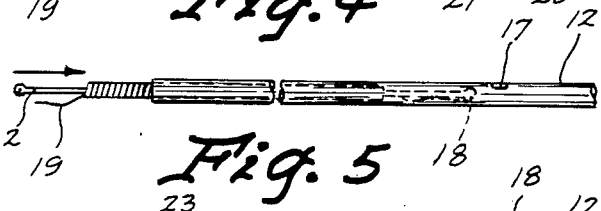
FIG. 5 shows the step of FIG. 4 when it is almost complete.
Figure 6:
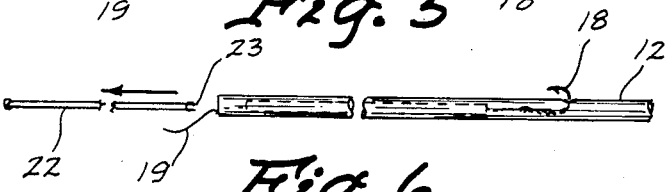
FIG. 6 shows the coil of wire and hook completely assembled and wherein the installing wire is being removed.

Referring now to the drawings, wherein like reference numerals designate identical or corresponding parts throughout the several views, FIG. 1 shows a bow (10) having an arrow (11) constructed in accordance with the present invention in readiness to be shot therefrom.

Figure 2:
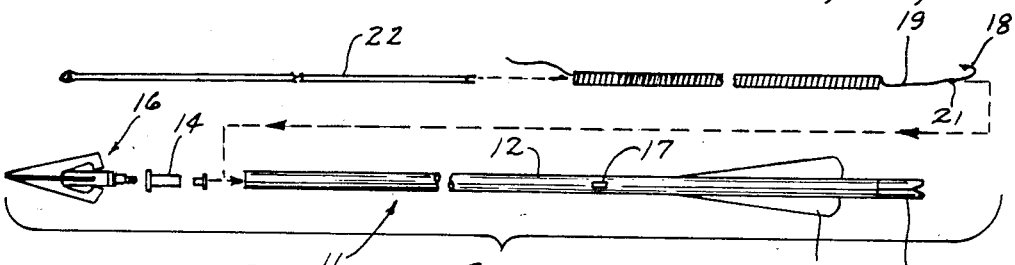
FIG. 2 is an exploded side elevational view of a first embodiment of the present invention.

Referring to FIG. 2, it is noted that an arrow shaft (12) forms the base of the apparatus (11) and is hollow. Typically, this shaft (12) can be made of aluminum, but other material such as fiberglass or graphite are possible instead. The arrow has a plurality of feathers or plastic veins used as fletching attached thereto by glue. An insert (14) can be glued into one end of the shaft (12) and a plastic nock (15) can be glued to the other end of the shaft (12).

The insert (14) is internally threaded so that it can receive a broadhead (16) on one end thereof. The shaft (12) as shown in FIGS. 2 and 5–8 has a slot (17) extending therethrough for reasons which will be explained below.

Figure 7:
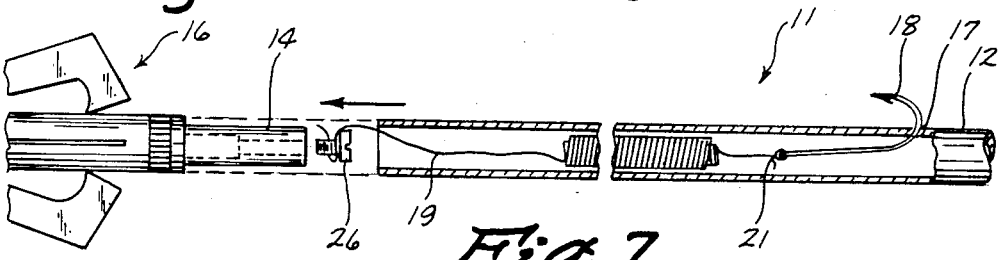
FIG. 7 is an exploded partial cross-sectional view showing a preferred embodiment of the invention.
Figure 8:
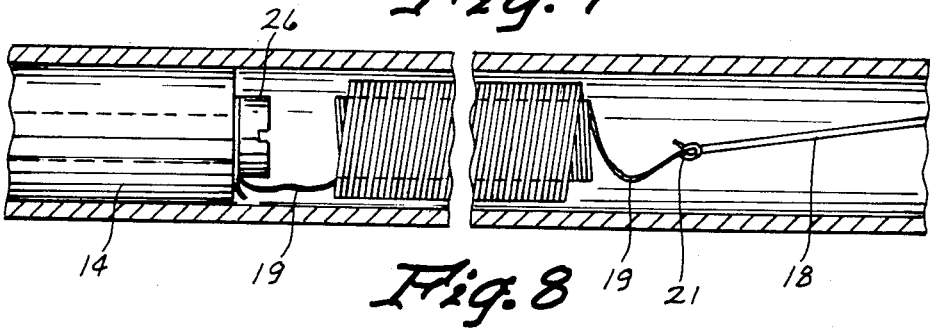
FIG. 8 is a still further enlarged cross-sectional view showing how the string is attached to the front end of the arrow and the rear end of the string is attached to the hook which extends out through an opening in the side of the shaft.

Referring now to FIGS. 3–6, it is noted that a hook (18) is attached to the string (19) by a knot (21). An installing tool (22) has a fork (23) on one end thereof. In operation, for installing the spool (19) into the shaft (12), the string or flexible line (19) is first wound onto the shaft (22) and the hook (18) is placed in the position shown in FIGS. 3 and 4. Then the shaft (22) is used to push the coil of string and the hook (18) into the shaft so as to get the hook (18) to extend through the opening (17) in the shaft (12) by the process shown in FIGS. 4–6. Then the rod (22) is removed from the coil (19) and shaft (12). Once that has been done, then a bolt (26) is utilized to attach the other end of the string (19) to the threaded portion of the insert (14) for example as shown in FIGS. 7 and 8, to thereby produce an arrow structure (11) which has one end of the string (19) connected effectively to the front of the shaft (12), and the other end of the string (19) connected to the hook (18).

Figure 12:
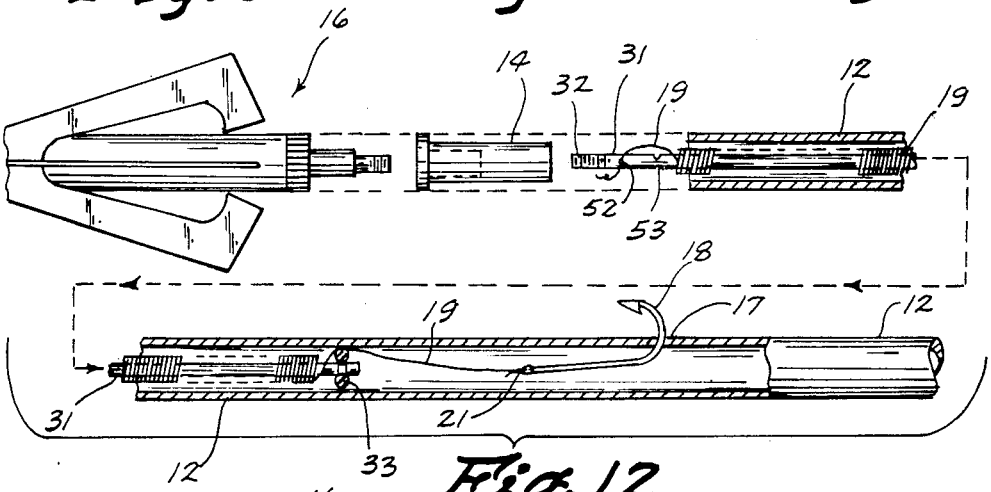
FIG. 12 is an exploded partial cross-sectional view of an alternate form of the present invention wherein a rod is threadably attached to the front end of the arrow and has the string wound therearound.

Referring now to FIG. 12, an alternate embodiment of the present invention is shown. In FIG. 12, a wire rod (31) has the string (19) wound therearound and has one end (32) thereof threaded so that it can be threadably attached into the insert (14). Once the hook (18) is in the position shown in FIG. 12, then and the rod (31) is shown disposed within the shaft (12), it can be attached to the insert (14) by threading the insert (14) thereon. An O-ring (33) can be utilized to keep the wire rod (31) from flopping around inside of the shaft (12). Insert (14) is then secured to the front end of the shaft (12) by gluing it in place. A broadhead (16) can then be threadably engaged into the other end of the insert (14) and the embodiment of FIG. 12 is ready to be used.

Figure 13:
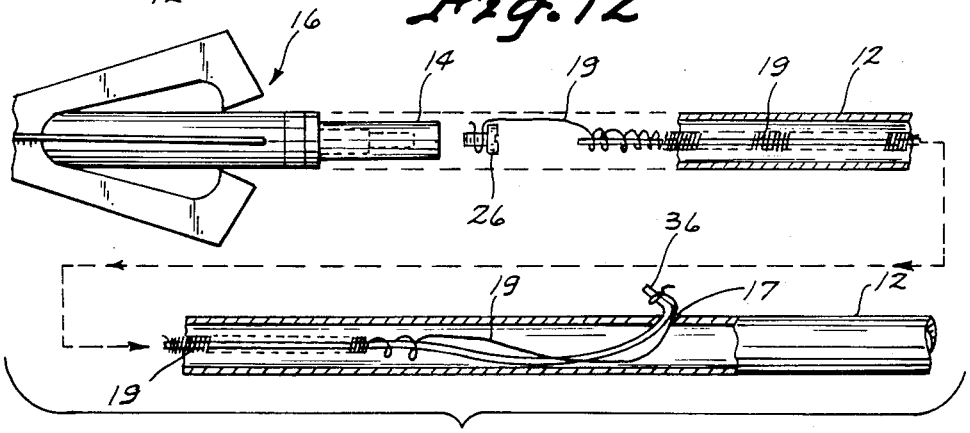
FIG. 13 is an exploded partial cross-sectional view similar to FIG. 12 and showing still another alternate embodiment of the present invention having the string attached to the front end of the arrow by a small bolt and the catching hook having the string wound therearound.

Another embodiment of the present invention is shown in FIG. 13 and it shows the bolt (26) being attached to the insert (14) and a hook (36) extends out through the opening (17) and has one end of the string (19) tied thereto. The string (19) is shown to have been wrapped around the portion of the hook (36) which extends down through the shaft (12). This embodiment is very similar to the embodiment shown in FIGS. 7 and 8, except that the hook (36) is longer on the bottom thereof and extends through the coil of string (19).

Figure 14:
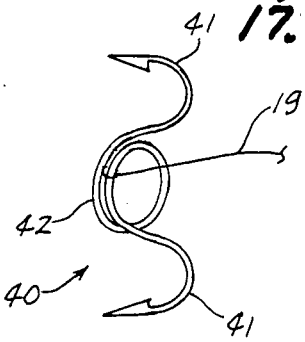
FIG. 14 is a perspective view of an alternate catching structure for frictionally engaging the front part of a shaft or point.
Figure 16:
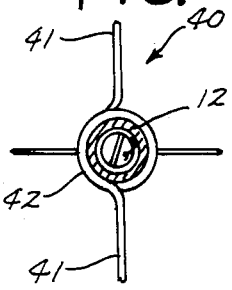
FIG. 16 is a view of the catching mechanism of FIG. 14 taken along 16—16 of FIG. 14.
Figure 17:
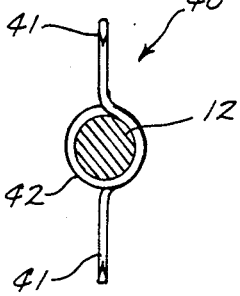
FIG. 17 is a view of the hook catching device of FIG. 14 taken along line 17—17.

Referring now to FIG. 14, it is noted that a different embodiment of the invention utilizes a double hooked-shaped catching device (40) which has a pair of hooks (41) formed in one piece with a helical center section (42).

Figure 15:
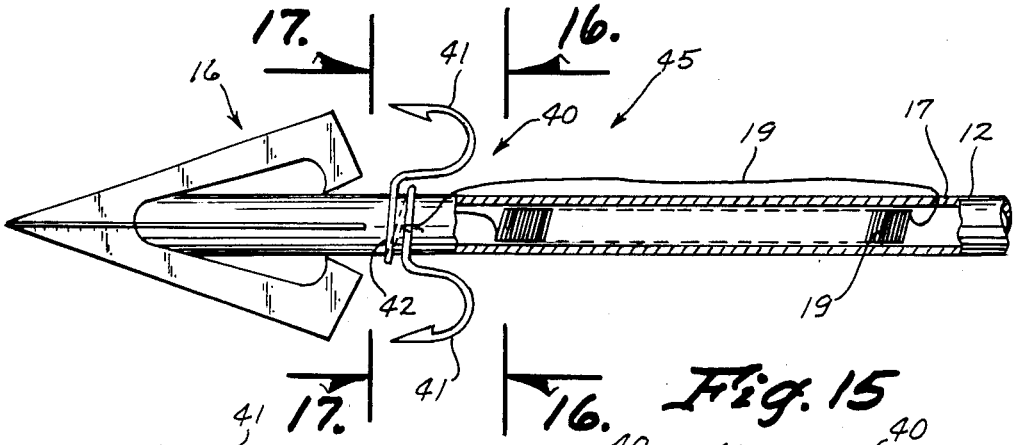
FIG. 15 shows a side elevational view of the hook of FIG. 14 disposed on an arrow shaft in an operative position ready to be shot.

Referring to FIG. 15, it is noted that the catching device (40) is shown frictionally attached to the front of a arrow combination (45) having a broadhead (16) and shaft (12) with the coil of string (19) extending through an opening (17) in the shaft (12). One end of the string is connected by a bolt in the manner shown in FIGS. 7 and 8, and the other ends of the string is tied to the center section (42) of the hook catching device (40).

Figure 18:
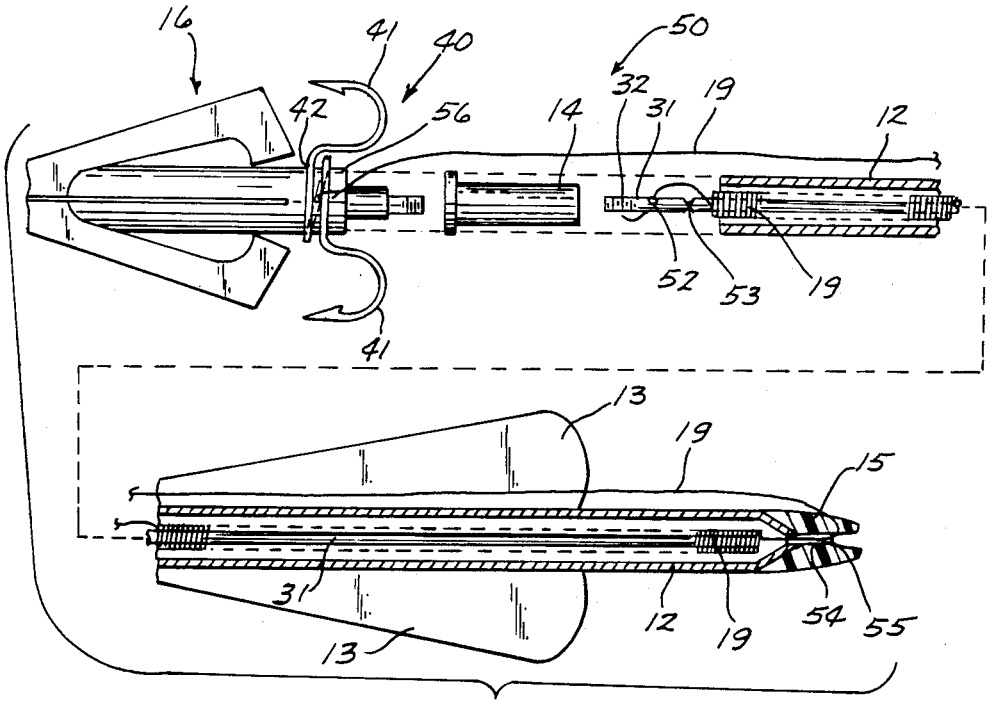
FIG. 18 is an enlarged, exploded, partial cross-sectional view of still another form of the invention including openings in the rear of the arrow for allowing the string to pass therethrough and being attached to the hook device in the other end of the string.

Referring now to FIG. 18, it is noted that a still further embodiment of the invention (50) is shown. The embodiment (50) has the catch device (40) having hooks (41) thereon and the central portion (42) having one end of the string (19) tied thereto. The string (19) is coiled around a shaft (31) just as is shown in the FIG. 12 embodiment. The shaft (31) has threads (32) thereon for threadably engaging the insert (14).

In order to put the embodiment (50) together, the string (19) is first wound around the shaft (31) and one end extends through the hole (52) in the shaft (31) and is tied thereto. A weakened place (53) is provided on the rod (31) for reasons which will be explained below. Once the string (19) is wound around the wire rod (31) and the one end attached through the hole (52) and tied thereto, then the insert (14) would be threaded onto the wire rod (31). The double hooked catch device (40) would be slipped onto the broadhead (16) around the circular portion (56) thereof and then the broadhead would be screwed into the insert (14). The insert (14) would then be glued into place and the other end of the string (19) would be tied to the hook-shaped member (40). The line (19) could be glued or taped to the shaft (12) if desired, but it must be attached in such a way that it will come loose later as the arrow strikes an object. Ideally, the outer diameter of broadhead portion (56) is larger than the outer diameter of shaft (12) so the member (40) will stay on the portion (56) by friction during flight, but will be pushed back onto shaft (12) when it strikes an object such as a turkey.

Figure 19:
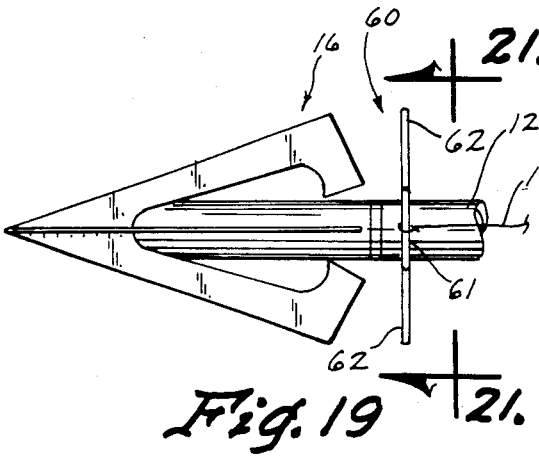
FIG. 19 is a partial side elevational view of a still further embodiment which is like FIG. 18 except that a snap frictional fit catching structure is frictionally attached to the shaft.
Figure 20:
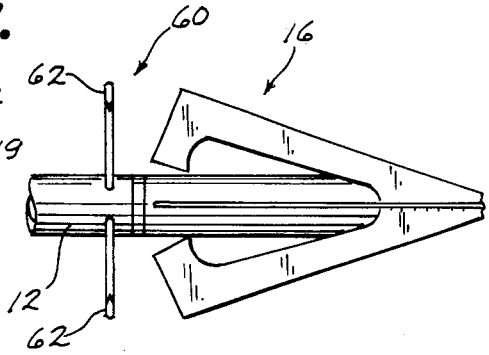
FIG. 20 is a partial side elevational view looking from the other side than as viewed in FIG. 19.
Figure 21:
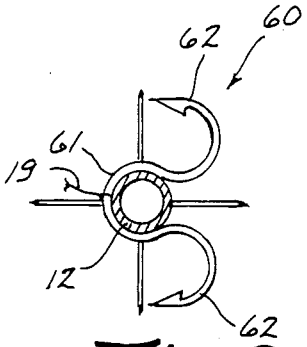
FIG. 21 is a cross-sectional view taken along line 21—21 of FIG. 19.

Referring now to FIGS. 19–21, it is noted that a still further embodiment of the invention is shown using a catching structure (60) instead of (40) as shown in FIG. 18. The catching structure (60) is a wire structure having hooks (62) and arcuate portion (61) which has a somewhat smaller inner diameter than the diameter of the shaft (12) so that the open side (the right side as shown in FIG. 21) can snap over the shaft (12) and the catching structure (60) is held onto the shaft (12) during the flight of the arrow until it strikes an object, at which time it will snap off of the shaft while the arrow shaft (12) continues to go into or through the object. The string (19) is tied to arcuate portion (61) of catching structure (60).

Figure 22:
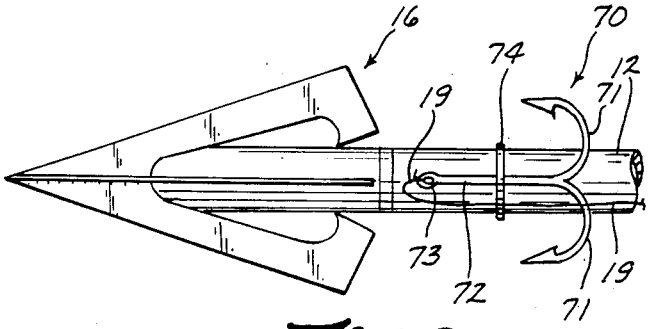
FIG. 22 is a partial side elevational view of a still further embodiment using a double fishing hook held tightly onto the arrow shaft by a small but heavy rubber band.

FIG. 22 shows a still further embodiment wherein a double fish hook (70) is held tightly onto the shaft (12) by a small but strong rubberband (74). A single or treble fishing hook could be used instead of double hook (70). The string (19) is tied to the eye (73) of shank (72) of hook (70). When the arrow shaft (12) is in flight, the hook (70) will be held securely to the shaft (12) in the position shown in FIG. 22; but, when the broadhead (16) penetrates an object, the hook (70) will catch on the outside of the object and be pulled off of shaft (12) with the string (19) attached thereto, as in the FIG. 18 embodiment (40). Alternatively, the rubberband (74) could be replaced by a piece of tape (not shown) which will keep the hook (70) in place while the arrow is in flight but which will break to allow the hook (70) to separate from the shaft (12) once the broadhead (16) penetrates an object.

Figure 9:
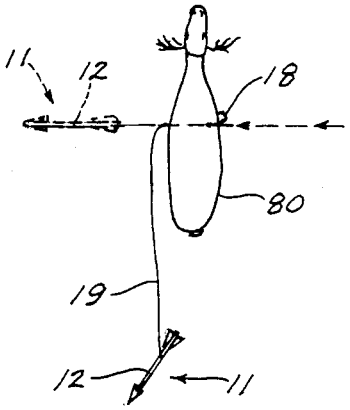
FIG. 9 shows how the invention operates if the arrow passes completely through an object such as a deer.

In operation, if the arrow structure (11, 30 or 35) as shown in FIGS. 8, 12 or 13, respectively, are shot through an animal (80) as shown in FIG. 9, then the hook (18) (or the hook (36)) will catch on the animal (80) as the arrow passes therethrough and string (19) will unravel to form a connection between the animal (80) and the arrow (11). As the animal retreats, the string (19) will continue to unravel until the animal stops or until the line all unravels. Consequently, one will be able to track the animal by following the string (19) from the arrow (11) to the animal (80).

Figure 10:
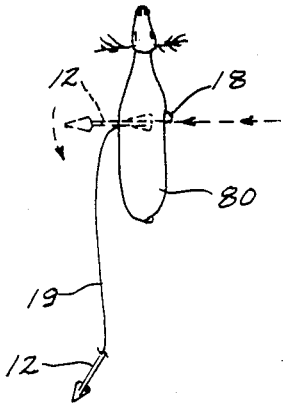
FIG. 10 illustrates how the present invention operates if the point of the arrow passes out through an object such as an animal, but the rear end does not.

If the arrow (11) extends only partially through the animal (80), for example as shown in FIG. 10, then normally the animal will go through the timber until the front end of the arrow breaks off, when that occurs, then the hook portion (18) or (35) will remain in the animal and the string (19) will unravel because the front end of the arrow typically will catch on a twig or grass, or on something as the animal moves through the woods. In like fashion then, the string (19) can be followed to find where the animal has finally gone down.

Figure 11:
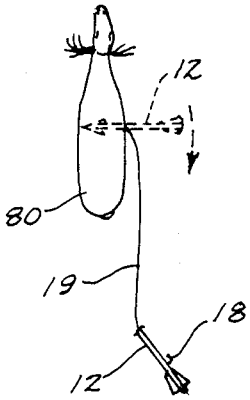
FIG. 11 shows how the invention operates if the point end of the arrow remains in the animal shot.

If it turns out that the arrow (11) does not pass completely through the animal (80), for example as shown in FIG. 11, then as the animal retreats, the rear end of the arrow, especially if it is an aluminum arrow, will break off and this rear end of the arrow will catch on brush, bushes or grass as the animal retreats through the wood. String will unravel and the animal can again be tracked by finding the end of the arrow or the string and following it to the animal (80).

Referring now to the operation of embodiments (45) and (50) of FIGS. 15 and 18, respectively, it will be noted that they operate similar to the aforementioned embodiments, but not exactly in the same way. Referring to FIG. 9, it will be noted that when the arrow is shot completely through an animal (80), or some other object such as a turkey, the hook-shaped member (40) will essentially stop when an object such as an animal (80) is penetrated and the arrow shaft (12) will pass completely therethrough, while the hook-shaped member stays in the animal (80). After that occurs, then the animal (80) will retreat and the string (19) will unwind either through an opening (17) in the shaft (12) in the FIG. 15 embodiment, or through openings (54) and (55) in the FIG. 18 embodiment.

If it happens that the string tracking arrow (45) or (50) do not pass completely through the animal (80), but instead only the point end passes therethrough, then typically the front end of the arrow will break off after it hits branches or the like as the animal runs through the woods and, again, the string (19) will unwind so that once the front end of the arrow or the string (19) is located, then it can be followed to the place where the animal (80) has expired.

If the string tracking arrow (45) or (50) as shown in FIGS. 15 and 18 only penetrate the animal (80) to an extent where the point end is still left in the animal (80), then, as the animal retreats through the woods, the rear end of the arrow will be broken off when it contacts branches or the like and the hook shaped catching device (40) will remain with the broken off end of the shaft whereby, the string (19) will unwind and form a connection between the hook (40) and the animal (80). Consequently, once the hook shaped member (40) catches on a twig or branch, then the string (19) will start to unwind and it can then be followed from the hook-shaped member to the animal (80). It will readily be appreciated that having a long length of string lying in the woods will greatly enhance the hunter's chances of finding and tracking the game shot whether or not a blood trail is present. Consequently, it can speed up recovery and significantly reduce the chances of the game shot would not be found.

Thus, it can be seen that at least all of the stated objectives have been achieved. Obviously, many modifications and variations of the present invention are possible in light of the above teachings. For example, hook portions (41) or (62) of FIGS. 18 and 19, respectively, could be of other configurations, such as just being straight. It is therefore to be understood that, within the scope of the appended claims, the invention may be practised otherwise than as specifically described.

I claim:

1. A string tracking apparatus for archery arrows comprising:

a hollow tubular shaft;

a point adapted to be attached to one end of said shaft;

a nock means for receiving a string attached to the other end of said shaft, said shaft being adapted to have fletchings attached to said other end thereof;

flexible line disposed within said shaft between the one end and the other end of said shaft;

means for operably attaching one end of said flexible line to said one end of said shaft;

catching means attached to the other end of said flexible line, said catching means having at least one end disposed outside of said shaft for catching onto an object when said arrow shaft penetrates said object; and means operatively associated with said shaft to permit the flexible line to be pulled from the interior of the shaft by a force pulling on said catching means.

2. The apparatus of claim 1 wherein the other end of said catching means is a hook-shaped member extending into said shaft.

3. The apparatus of claim 2 wherein said other end of said hook-shaped member has said flexible line disposed therearound.

4. The apparatus of claim 1 including an insert disposed in said one end of the shaft, said insert being internally threaded.

5. The apparatus of claim 4 including a threaded fastener extending into said threaded insert for holding said one end of the flexible line to said insert.

6. The apparatus of claim 4 including a rod threaded at one end thereof and having said flexible line wound therearound and said one end of said threaded rod being threadably engaged with said internally threaded insert.

7. The apparatus of claim 6 including means for weakening said rod at a point near the threaded end thereof as compared to its strength along the rest of the length thereof, whereby if said rod breaks it is more likely to break at said weakened point.

8. The apparatus of claim 6 including loop means for frictionally attaching said catching means to said shaft adjacent to the point thereof.

9. The apparatus of claim 8 wherein said catching means comprises at least one hook shaped member attached to said loop means.

10. The apparatus of claim 9 wherein said hook has barb means disposed on a sharpened end thereof.

11. The apparatus of claim 6 wherein said arrow includes fletching on the other end thereof and said loop means includes means for allowing said arrow to pass completely through said loop means once said catching means engages said object.

* * * * *